US009067246B2

(12) United States Patent
Reyes et al.

(10) Patent No.: US 9,067,246 B2
(45) Date of Patent: Jun. 30, 2015

(54) WATER SERVICE LINE REPAIR

(71) Applicant: R2 SOLUTIONS LLC, Portland, OR (US)

(72) Inventors: Mathias Hernandez Reyes, Salem, OR (US); Robert Hernandez Reyes, Portland, OR (US)

(73) Assignee: R 2 Solutions LLC, Portland, OR (US)

( * ) Notice: Subject to any disclaimer, the term of this patent is extended or adjusted under 35 U.S.C. 154(b) by 182 days.

(21) Appl. No.: 14/032,039

(22) Filed: Sep. 19, 2013

(65) Prior Publication Data

US 2014/0076361 A1 Mar. 20, 2014

Related U.S. Application Data

(63) Continuation-in-part of application No. 13/616,928, filed on Sep. 14, 2012, now abandoned.

(51) Int. Cl.

| | |
|---|---|
| ***B08B 9/00*** | (2006.01) |
| ***B08B 9/032*** | (2006.01) |
| ***E03B 7/00*** | (2006.01) |
| *E03C 1/304* | (2006.01) |
| *B08B 9/02* | (2006.01) |
| *B08B 1/00* | (2006.01) |
| *B08B 9/027* | (2006.01) |
| *B08B 3/04* | (2006.01) |
| *B08B 3/00* | (2006.01) |

(Continued)

(52) U.S. Cl.

CPC ..... *B08B 9/0326* (2013.01); *E03C 1/304* (2013.01); *B08B 9/02* (2013.01); *B08B 9/032* (2013.01); *B08B 1/001* (2013.01); *B08B 9/027* (2013.01); *B08B 9/00* (2013.01); *B08B 3/04* (2013.01); *B08B 3/00* (2013.01); *B08B 1/00* (2013.01); *E03C 1/302* (2013.01); *E03C 1/30* (2013.01); *B08B 3/02* (2013.01); *B08B 9/0321* (2013.01); *E03C 1/306* (2013.01); *E03C 1/308* (2013.01); *E03F 9/00* (2013.01); *E03F 9/002* (2013.01); *E03F 9/005* (2013.01); *E03F 9/007* (2013.01); *E03B 7/006* (2013.01)

(58) Field of Classification Search

CPC ..... B08B 1/00; B08B 1/001; B08B 3/00; B08B 3/02; B08B 3/04; B08B 9/00; B08B 9/02; B08B 9/027; B08B 9/032; B08B 9/0321; B08B 9/0326; E03C 1/30; E03C 1/302; E03C 1/304; E03C 1/306; E03C 1/308; E03F 9/00; E03F 9/002; E03F 9/005; E03F 9/007

See application file for complete search history.

(56) References Cited

U.S. PATENT DOCUMENTS

| | | | |
|---|---|---|---|
| 2,621,668 | A | 12/1952 | Crispin |
| 2,668,551 | A | 2/1954 | Clement |

(Continued)

OTHER PUBLICATIONS

Dec. 13, 2012, Office action US Patent and Trademark Office, in U.S. Appl. No. 13/616,928, which shares the same priority as this U.S. application.

(Continued)

*Primary Examiner* — Bibi Carrillo
(74) *Attorney, Agent, or Firm* — Kolisch Hartwell, P.C.

(57) ABSTRACT

Methods and apparatus for removing unwanted build-up in a pipe, such as a water service line, by creating and directing one or more hydraulic pulses toward the build-up. This may be accomplished, for example, by fluidically connecting a piston assembly to the pipe, and then striking or otherwise abruptly moving the piston to produce a hydraulic pulse.

18 Claims, 6 Drawing Sheets

(51) Int. Cl.

| | |
|---|---|
| *E03C 1/302* | (2006.01) |
| *E03C 1/30* | (2006.01) |
| *B08B 3/02* | (2006.01) |
| *E03C 1/306* | (2006.01) |
| *E03C 1/308* | (2006.01) |
| *E03F 9/00* | (2006.01) |

(56) References Cited

U.S. PATENT DOCUMENTS

| | | | | |
|---|---|---|---|---|
| 3,156,584 | A | 11/1964 | Yurdin | |
| 3,658,589 | A | 4/1972 | Shaddock | |
| 4,724,007 | A | 2/1988 | Barry et al. | |
| 4,898,197 | A | 2/1990 | Barry et al. | |
| 4,919,154 | A | 4/1990 | Engle | |
| 2003/0051746 | A1 | 3/2003 | Park | |
| 2004/0129498 | A1* | 7/2004 | Pujol | 184/6.14 |
| 2005/0145106 | A1* | 7/2005 | Solomon, Jr. | 92/172 |
| 2012/0247519 | A1 | 10/2012 | Dondurur et al. | |

OTHER PUBLICATIONS

Mar. 20, 2013, Office action US Patent and Trademark Office, in U.S. Appl. No. 13/616,928, which shares the same priority as this U.S. application.

* cited by examiner

WATER SERVICE LINE REPAIR

CROSS-REFERENCE TO RELATED APPLICATION

This application is a continuation-in-part of U.S. patent application Ser. No. 13/616,928, filed Sep. 14, 2012, now abandoned which is hereby incorporated by reference into the present disclosure.

BACKGROUND

Water service lines generally provide water to residential and commercial buildings from a public or privately owned water main. To do this, individual service lines typically branch off the main line and pass through a water meter, which records the amount of water passing through the meter, before delivering the water to the building. However, it is not uncommon for such branch service lines to experience a reduction in water flow due to build-up, such as mineral build-up, somewhere within the line. Correcting such flow reductions typically requires the excavation, removal and replacement of a portion of the service line, which is expensive and time-consuming. Accordingly, there is a need for improved techniques in repairing water service lines that are experiencing reduced water flow.

SUMMARY

The present teachings relate to methods and apparatus for removing unwanted build-up in a pipe, such as a water service line, by creating and directing one or more hydraulic pulses toward the build-up. This may be accomplished, for example, by fluidically connecting a piston assembly to the pipe, and then striking or otherwise abruptly moving the piston to produce a hydraulic pulse.

DETAILED DESCRIPTION

Water distribution networks, whether public or private, may include a network of principal or main water lines, also known as water mains. Water is distributed from a water main to a plumbing system associated with real property by way of individual service lines passing through a water meter. A water meter records the amount of water passing through a service line and may separate a supply side or water main side from a customer side or property side of an individual service line associated with the serviced property. A water service line may be a pipe, typically not smaller than ¾ inches in diameter, delivering water at a flow rate that may be measured in gallons per minute. Mineral buildup in a water service line may decrease the flow rate below a minimum acceptable flow rate established by a public utility water main service, or another person or entity affiliated with a water distribution network, requiring some form of maintenance to restore water flow to an acceptable level.

When a water service line is partially or entirely blocked, such as by mineral build-up, the water service line is often removed and replaced, which is time consuming and costly, and even more so if the blocked line runs under a road. The present teachings are generally directed toward dislodging mineral build-up in a water service line, in a manner that does not require significant excavation or replacement of any portion of the service line. Generally speaking, this is accomplished using a piston placed in fluid connection with the service line in the general vicinity of the suspected build-up. The piston is configured create pulses of water, such as hydraulic shock waves, which travel into the water service line and dislodge the build-up. Accordingly, by avoiding the need to excavate and/or replace portions of the service line, methods and apparatus according to the present teachings can significantly reduce the time and money required to remove unwanted build-up within the line.

Figure 1:
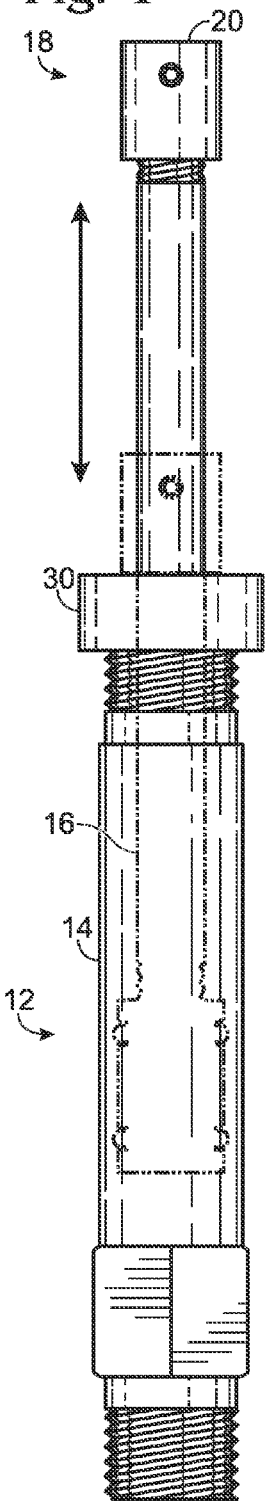
FIG. 1 is a side elevational view of a piston assembly that may be used to remove unwanted build-up from a water service line, according to aspects of the present teachings.
Figure 2:
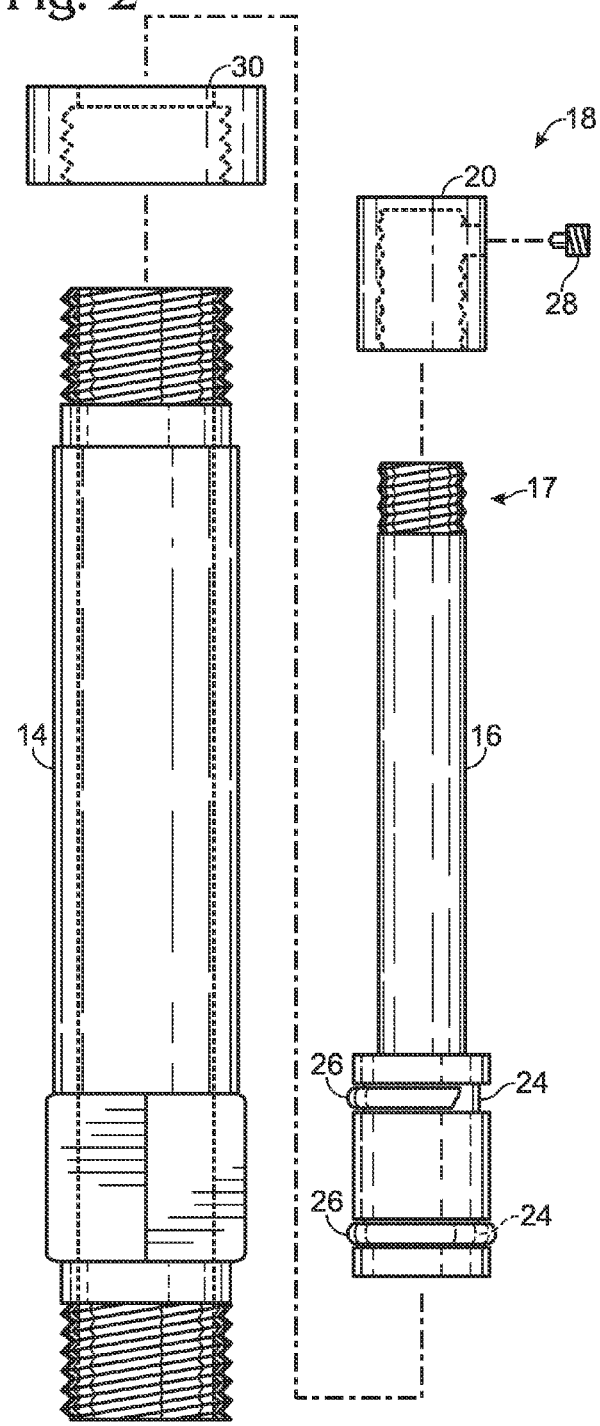
FIG. 2 is an exploded side elevational view of the piston assembly of FIG. 1.

FIG. 1 is a side elevational view and FIG. 2 is a side elevational exploded view depicting a piston assembly, generally indicated at 12, for dislodging build-up in a water service line. The piston assembly 12 includes a hollow outer sleeve 14 configured to be connected to a water service line, and a piston 16 disposed within sleeve 14 and configured to move within the sleeve in a substantially fluid tight manner. A bleeder assembly, generally indicated at 18, is connected to the head portion, generally indicated at 17, of piston 16 and is configured to allow removal of air from within sleeve 14.

Bleeder assembly 18 may, for example, be comprised of a bleeder plug 28 and a wear cap 20. Wear cap 20 may be made from any suitable resilient material, such as stainless steel, so as to withstand repeated forcible blows from a mallet. Bleeder plug 28 may be removably inserted into an aperture in wear cap 20 so as to allow air to be bled out of the piston assembly 12. A top cap 30 may be slid over piston 16 as piston 16 is disposed inside sleeve 14. Top cap 30 may be removably attached to sleeve 14. Piston 16 also may have at least one o-ring groove 24. An o-ring 26 may be disposed within each o-ring groove 24 to create a substantially fluid tight interface with sleeve 14.

Figure 4:
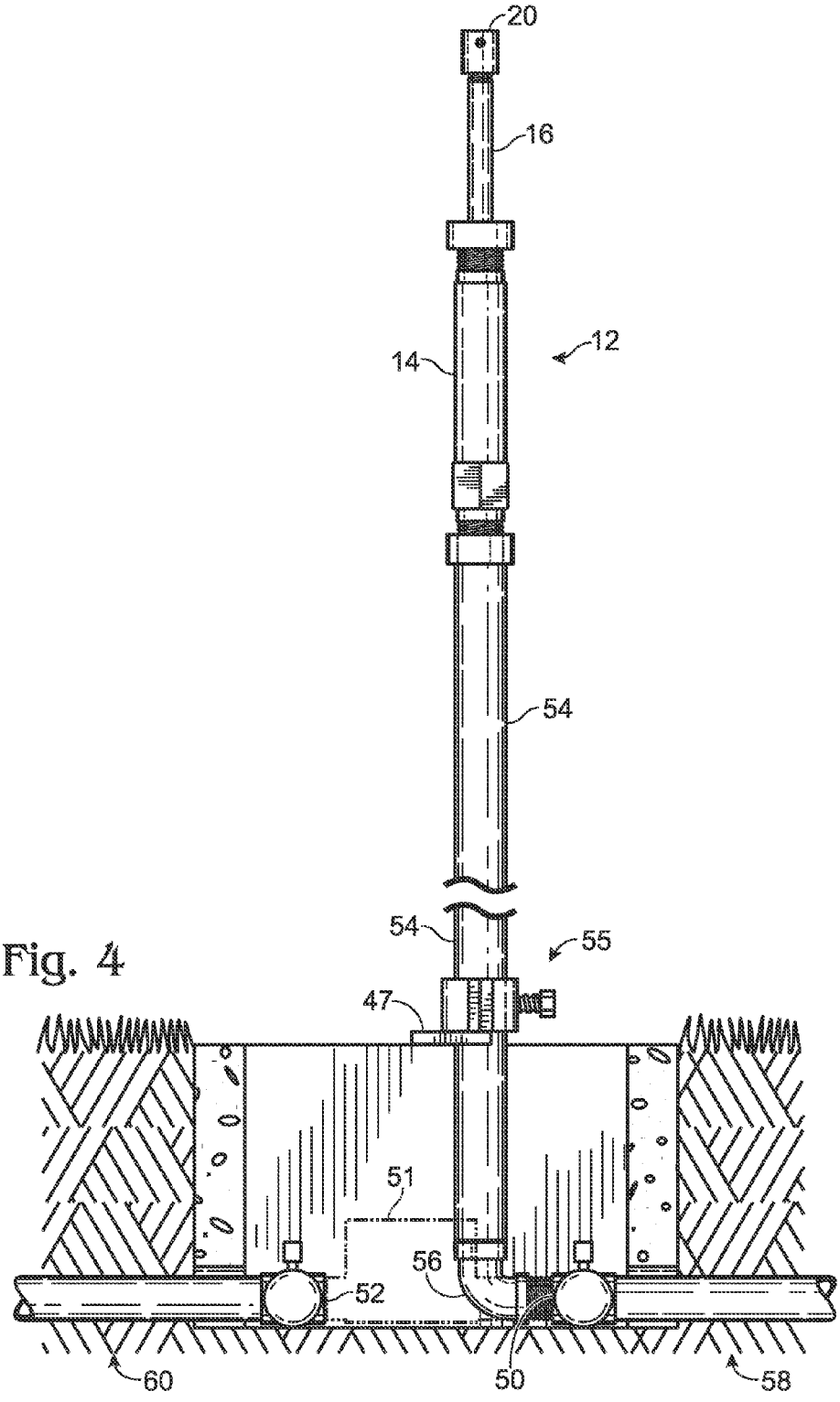
FIG. 4 is a front elevational view of the piston assembly of FIG. 1 attached to a water service line using an extension pipe and an angled pipe, according to aspects of the present teachings.

FIG. 4 is a side elevational view depicting the piston assembly 12 connected to an extension pipe 54 in a substantially vertical orientation. Extension pipe 54 is connected to a 90 degree angled pipe 56. If the supply side of the water service line, which is generally indicated at 58, is blocked, then 90 degree angled pipe 56 with extension pipe 54 and piston assembly 12 can be attached to supply side connection point 50. Supply side connection point 50, as well as a customer side connection point 52, may be comprised of at least one valve so as to stop water from flowing out of the water service line, such as a curb stop as shown in FIG. 4 or a 90 degree brass meter stop (not shown). The valve configurations in water service lines vary, but the variations are not material to the present teachings. If the customer side of the water service line, which is generally indicated at 60, is blocked, then 90 degree angled pipe 56 with extension pipe 54 and piston assembly 12 can be connected to a customer side connection point 52. To expose supply side connection point 50 and customer side connection point 52, a water meter 51 was removed from the service line depicted in FIG. 4.

Figure 3:
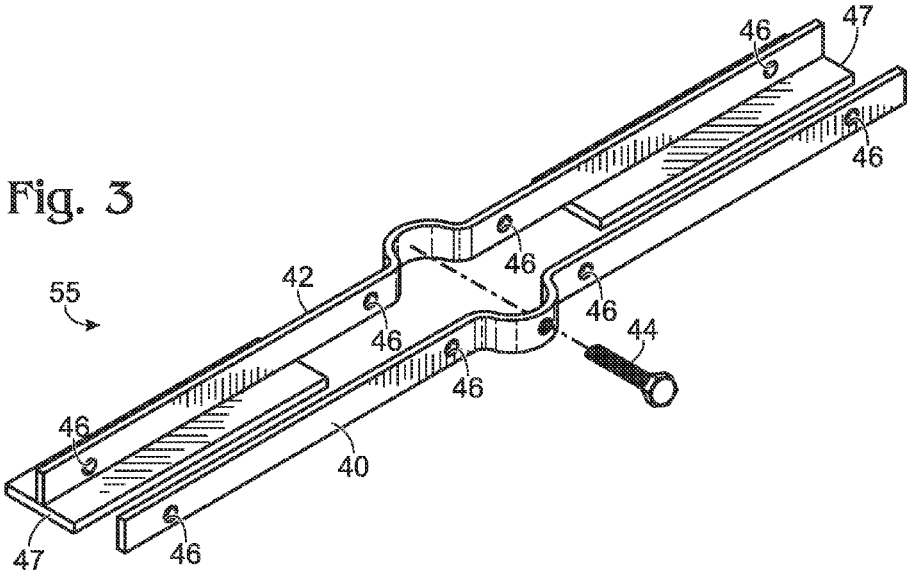
FIG. 3 is an isometric view of a support brace that may be used to brace a piston assembly to withstand non-longitudinal forces, according to aspects of the present teachings.

An adjustable support brace, generally indicated at 55 and shown in more detail in FIG. 3, can be operatively attached to extension pipe 54 and positioned with brace plates 47 of the brace against the ground and configured in such a way as to brace the piston assembly 12 with respect to non-longitudinal forces. The piston assembly 12, extension pipe 54, and angled pipe 56 can be assembled in whatever order the user deems appropriate—for instance, in cases of low overhead clearance the user may need to attach the angled pipe 56 to the piston assembly 12 and not use extension pipe 54 in order to allow more overhead clearance for swinging a mallet. If extension pipe 54 is not used, then adjustable support brace 55 could instead be operatively attached directly to piston assembly 12, for instance by being attached to outer sleeve 14.

FIG. 3 is an exploded view of adjustable support brace 55. A first portion 40 of adjustable support brace 55 may include a tightening screw 44 for securing adjustable support brace 55 to either extension pipe 54 or piston assembly 12. First portion 40 of the support brace also has bolt holes 46. A second portion 42 of the support brace includes bolt holes 46 and brace plates 47. First portion 40 and second portion 42 of brace 55 are operatively attached to each other and to the piston assembly by positioning the two portions of the brace on either side of the piston assembly with brace portions 47 braced against the ground or some other stable surface, inserting bolts through corresponding bolt holes 46 and tightening nuts onto the receiving ends of the bolts. Tightening screw 44 may be used to eliminate any play between the brace and the extension pipe or piston assembly to which the brace is attached. Any other attachment mechanism that creates a compressive force between the two portions 40 and 42 of the support brace may be used.

Figure 5:
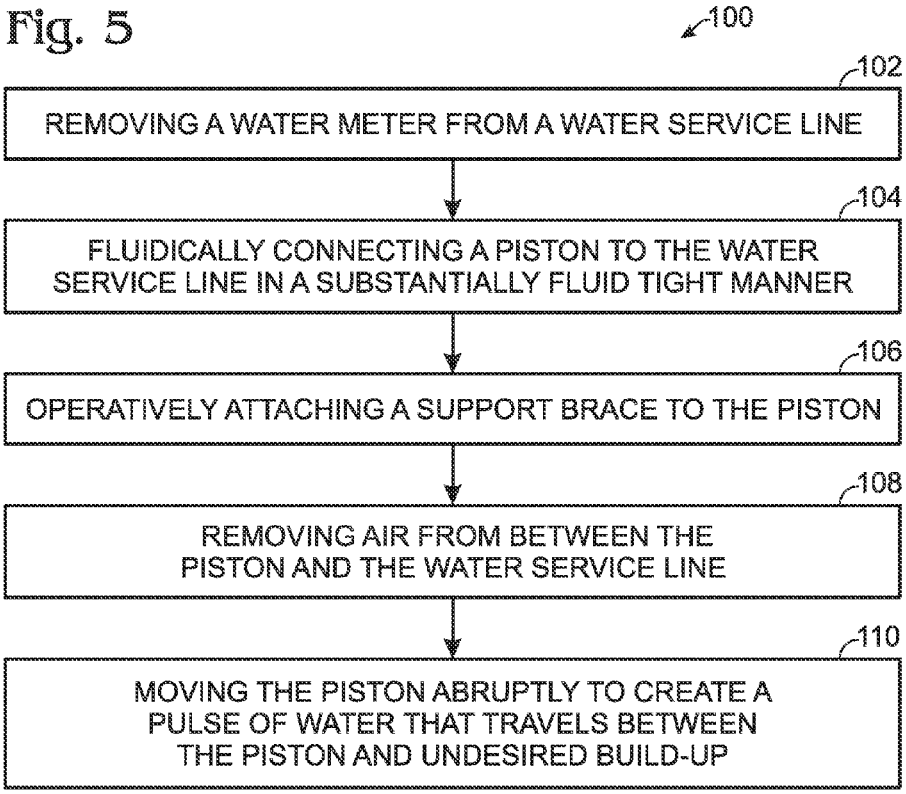
FIG. 5 is a flowchart depicting a method of dislodging mineral build-up in a water service line, according to aspects of the present teachings.

FIG. 5 depicts a method, generally indicated at 100, of dislodging mineral build-up in a water service line using an apparatus such as piston assembly 12 described above and depicted in FIGS. 1-4.

At step 102, a water meter from a water service line may be removed to expose a supply side connection point at a supply side of the service line and a customer side connection point at a customer side of the service line. At step 104, a piston assembly is fluidically connected to the water service line at one of the connection points in a substantially fluid tight manner. This connection may involve connecting one or more intermediate pipes and/or fittings between the piston assembly and the connection point to the service line.

For example, the fluid connection of the piston to one of the connection points may include connecting an angled pipe having a 90 degree bend to one of the connection points and fluidically connecting the piston to the angled pipe. The fluid connection of the piston to the angled pipe may include connecting an extension pipe to the angled pipe and fluidically connecting the piston to the extension pipe. The fluid connection of the piston to the extension pipe may include connecting a sleeve to the extension pipe and disposing the piston within the sleeve in a substantially fluid tight manner. The connection of the sleeve to the extension pipe may include connecting a flange to the connecting pipe and connecting the sleeve to the flange. Any other suitable extension pipes, angled pipes and/or fittings may be used to achieve a fluidic connection of the piston assembly to the service line in a given situation.

At step 106, a support brace may be operatively attached to the piston. For example, as described previously, a suitable brace may include two portions that can be placed on opposite sides of the piston assembly. One or more brace portions of the support brace may be disposed against a substantially immovable surface, such as the ground or the sides of a meter box from which a water meter was removed to expose the supply side and customer side connection points. The brace then may be securely attached to the piston assembly through the use of bolts, screws, or any other suitable compressive mechanism.

At step 108, air is removed from between the piston and the water service line, for instance by opening a suitable valve in the service line, and then opening a bleeder valve in the piston assembly to allow water to flow into the piston assembly. At step 110, the piston is moved abruptly, possibly by striking a head portion of the piston with a mallet, to create a pulse of water that travels between the piston and undesired build-up in the service line. This will typically cause a hydraulic shock wave or some other form of hydraulic pulse to travel through the service line and deliver a force to the build-up. One or more such hydraulic pulses may be sufficient to dislodge any amount of build-up within the service line, without requiring expensive and time-consuming removal and/or replacement of significant portions of the line as in previous methods.

Figure 6:
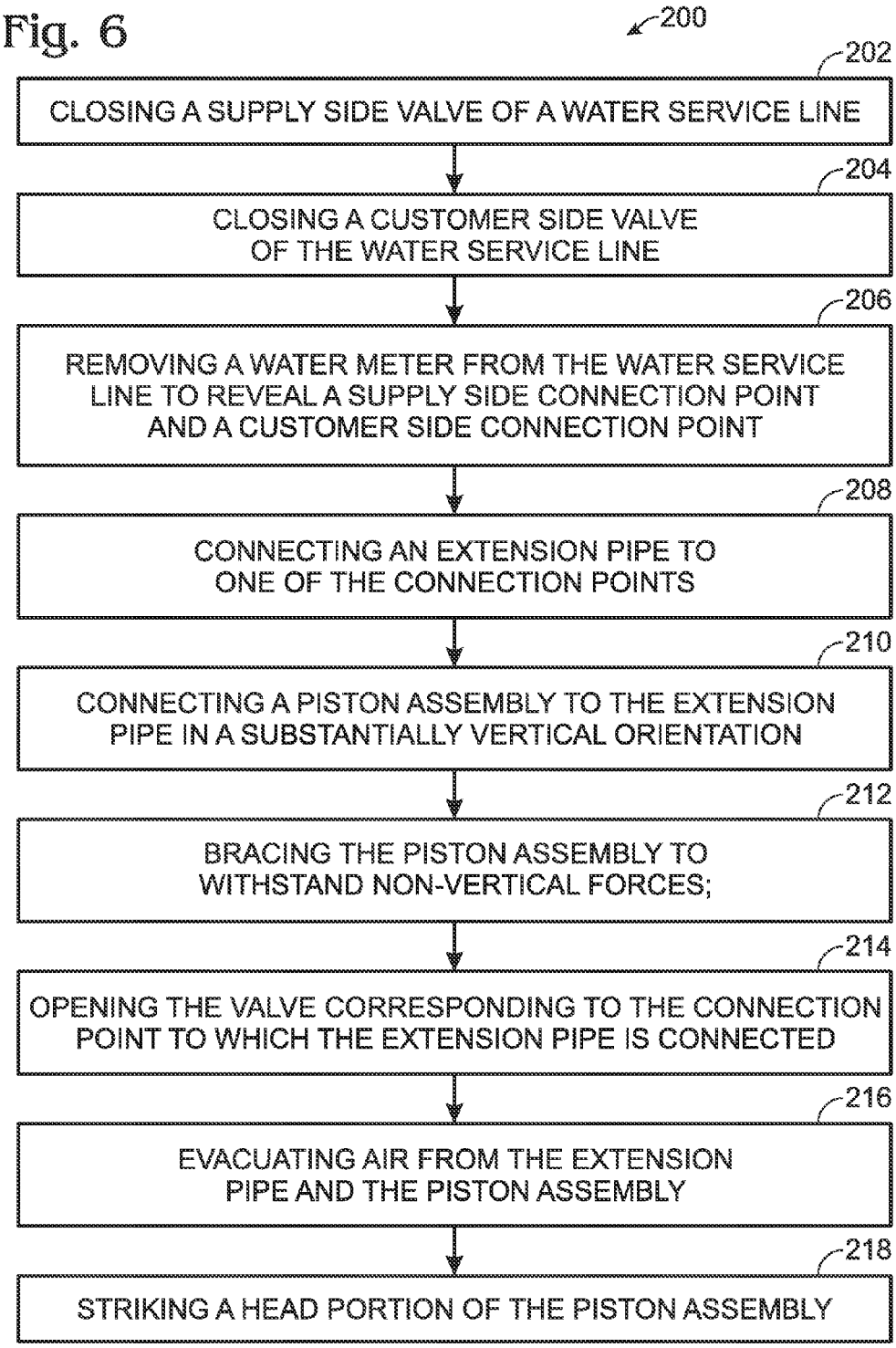
FIG. 6 is a flowchart depicting another method of dislodging mineral build-up in a water service line, according to aspects of the present teachings.

FIG. 6 depicts another method, generally indicated at 200, of dislodging mineral build-up in a water service line using an apparatus such as piston assembly 12 described above and depicted in FIGS. 1-4.

At step 202, a supply side valve of a water service line is closed in the vicinity of a water meter, and at step 204, a customer side valve of the water service line is closed, also in the vicinity of the water meter. These valve closures effectively isolate a section of the line to which the water meter is attached, allowing the water meter to be removed without any significant leakage of water from the line.

At step 206, the water meter is removed from the water service line to reveal a supply side connection point and a customer side connection point for attachment of a build-up removal apparatus. At step 208, an extension pipe is connected to one of the connection points. Depending on the orientation of the water meter and its connections to the service line, connecting the extension pipe may include connecting a 90 degree angled pipe to either the supply side connection point or the customer side connection point, and connecting the extension pipe to the angled pipe. Alternatively, in some cases connecting an extension pipe may be omitted entirely.

At step 210, a piston assembly is connected to the extension pipe in a substantially vertical orientation, and at step 212, the piston assembly is braced to withstand non-vertical forces. For example, an adjustable brace, such as brace 55 depicted in FIG. 3 and described previously, may be attached to the extension pipe, and a portion of the adjustable brace may be braced against the ground or the sides of the water meter box.

At step 214, the valve corresponding to the connection point to which the extension pipe is connected is opened. At step 216, air is evacuated from the extension pipe and the piston assembly. Evacuating air from the extension pipe and the piston assembly may include, for example, opening a bleeder valve until the air is evacuated and then closing the bleeder valve. At step 218, the head portion of the piston assembly is struck to cause a hydraulic shock wave to travel from the piston assembly into the water service line. The head portion may be struck repeatedly, for instance with a mallet, until build-up in the water service line has been dislodged to a desired degree.

Figure 7:
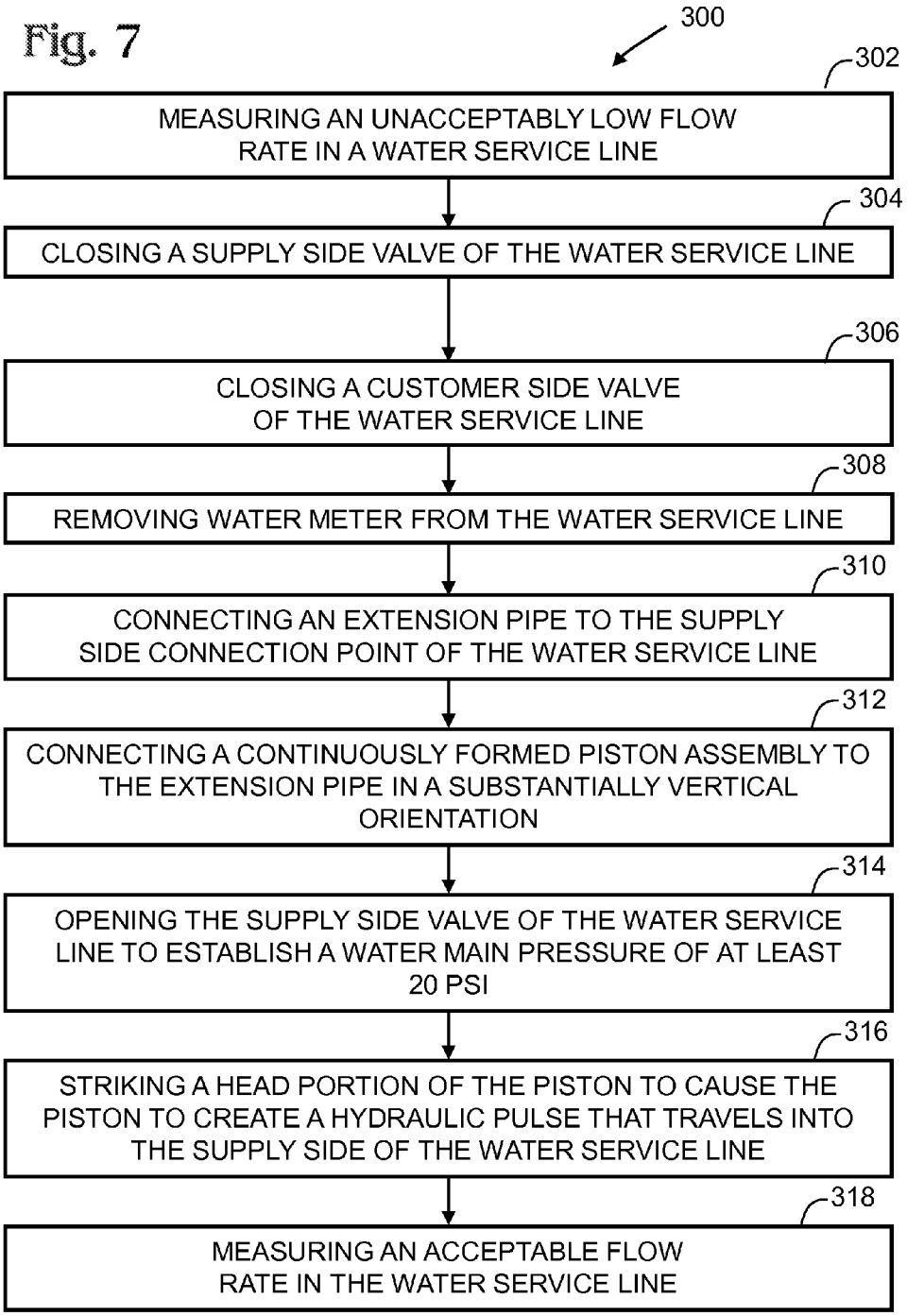
FIG. 7 is a flowchart depicting still another method of dislodging mineral build-up in a water service line, according to aspects of the present teachings.

FIG. 7 depicts another method, generally indicated at 300, of dislodging mineral build-up in a water service line using an apparatus such as piston assembly 12 described above and depicted in FIGS. 1-4.

At step 302, a flow rate in a water service line connecting a public utility water main to a plumbing system associated with a real property is measured and determined to be unacceptably low. An unacceptably low flow rate as established by a public water main utility service may be, for example, below 20 gallons per minute. However, any flow rate at or below which a customer or property owner may be permitted to request maintenance from a water main utility may be determined to be an unacceptably low flow rate, and the precise threshold between an unacceptably low flow rate and an acceptable flow rate may vary from one water service system to another.

At step 304, a valve on a supply side or water main side of a water service line is closed, and at step 306, a valve on a customer side or property side of a water service line is closed. The supply side valve and the customer side valve will typically, but not always, be disposed in close proximity to the water meter, and will often be accessible within a water meter enclosure located on or near the serviced property.

At step 308, the water meter is removed from the water service line after valve closures effectively isolate the water meter, allowing removal of the water meter without significant leakage of water. Removal of a water meter will typically reveal two separate connection points, one on a water main or supply side of the water meter, and the other on a customer or property side of the water meter. These connection points may be referred to respectively as a "supply side connection point" and a "customer side connection point" of the water service line.

At step 310, an extension pipe is connected to the connection point on the water main or supply side of an individual service line, i.e. to the supply side connection point of the water service line.

At step 312, a piston assembly is connected to the extension pipe in a substantially vertical orientation, creating a connection between the piston assembly and the supply side or water main side of the water service line. This connection is made in a substantially fluid tight manner, such that the connection will withstand the relatively high pressures of a public water main system over an indefinite period of time, without significant leakage. The piston assembly may be, for example, a continuously formed piston assembly having a hollow outer sleeve and a piston disposed within the sleeve. The piston of the continuously formed piston assembly may be configured to move within the sleeve of the assembly in a substantially fluid tight manner while exposed to a hydrostatic pressure of at least 100 psi, which is typical of many public utility water mains. Thus, a piston assembly according to the present teachings will typically be configured to withstand a water pressure of at least 100 psi, for an indefinite period of time, without leaking significantly. Additionally, a top surface or head portion of the piston may be configured to withstand repeated blows from a mallet.

At step 314, the supply or water main side valve of the water service line is opened to establish a water main pressure against a bottom surface of the piston of the piston assembly. The water main pressure established against the piston will typically be at least 20 psi, and in many cases may be at least 40 psi, 65 psi, 100 psi, 150 psi, or any other pressure at which a public water main may operate. Piston assemblies according to the present teachings should be configured to withstand the water main pressure anticipated in a particular situation. Because of the variation of water main pressures, piston assemblies according to the present teachings will often be configured to withstand at least some maximum pressure expected in any water main system, such as 150 psi, 200 psi, or more.

At step 316, a head portion or top surface of a piston assembly is struck, causing the piston to be moved abruptly such that the bottom surface of the piston creates a hydraulic pulse to travel through the water service line. More specifically, striking the head portion of the piston assembly causes a hydraulic pulse to travel from the bottom surface of the piston into the supply side or water main side of a water service line. A hydraulic pulse, such as a pulse created by striking the piston assembly, has been found effective to dislodge mineral buildup within the water service line itself, and/or a junction between the water service line and the water main, commonly known as the "corporation stop" of the service line.

Because striking the piston assembly to create hydraulic pulses causes an increase in the water pressure exerted against the piston, piston assemblies according to the present teachings will typically be configured to withstand pressures exceeding the expected water main pressure by a significant amount. For example, when water main pressures on the order of 100 psi are expected, the piston assembly may be configured to withstand 200 psi or even 300 psi of pressure, to accommodate the pressure increases resulting from mallet strikes.

At step 318, an acceptable flow rate is measured in the water service line. For example, an acceptable flow rate may be greater than 20 gallons per minute, or may be any other minimum flow rate established by a water distribution service.

Figure 8:
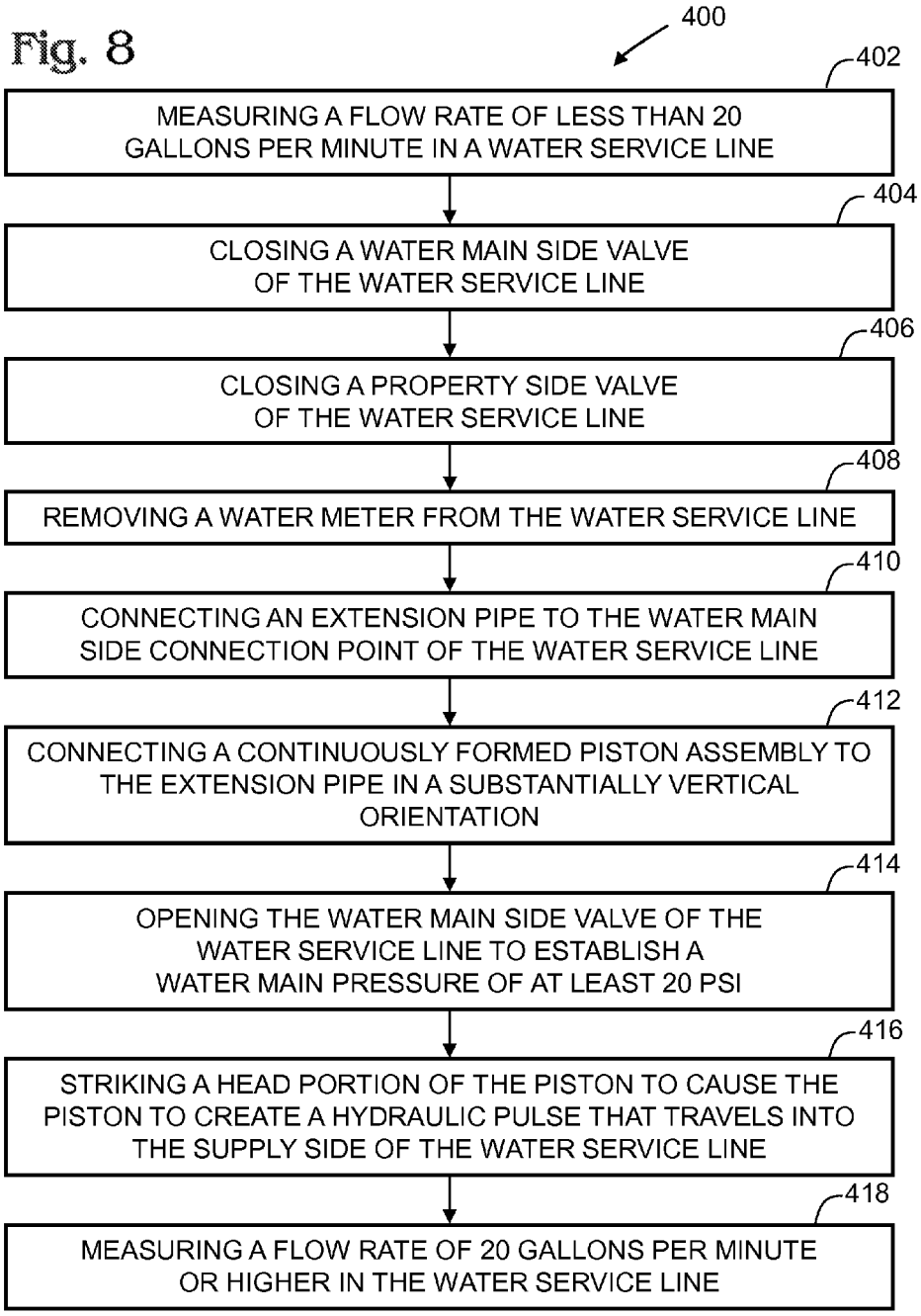
FIG. 8 is a flowchart depicting yet another method of dislodging mineral build-up in a water service line, according to aspects of the present teachings.

FIG. 8 depicts yet another method, generally indicated at 400, of dislodging mineral build-up in a water service line using an apparatus such as piston assembly 12 described above and depicted in FIGS. 1-4. Method 400 is generally similar to method 300, except that in method 400, a particular threshold is used to determine whether a measured flow rate in a water service line is acceptable.

At step 402, a flow rate in a water service line connecting a public utility water main to a plumbing system associated with a real property is measured to be less than 20 gallons per minute. As described previously, this is a typical threshold between an unacceptably low flow rate and an acceptable flow rate in a water service line.

At step 404, a valve on a supply side or water main side of a water service line is closed, and at step 406, a valve on a customer side or property side of a water service line is closed. The supply side valve and the customer side valve will typically, but not always, be disposed in close proximity to the water meter, and will often be accessible within a water meter enclosure located on or near the serviced property.

At step 408, the water meter is removed from the water service line after valve closures effectively isolate the water meter, allowing removal of the water meter without significant leakage of water. Removal of a water meter will typically reveal two separate connection points, one on a water main or supply side of the water meter, and the other on a customer or property side of the water meter. These connection points may be referred to respectively as a "supply side connection point" and a "customer side connection point" of the water service line.

At step 410, an extension pipe is connected to the connection point on the water main or supply side of an individual service line, i.e. to the supply side connection point of the water service line.

At step 412, a piston assembly is connected to the extension pipe in a substantially vertical orientation, creating a connection between the piston assembly and the supply side or water main side of the water service line. This connection is made in a substantially fluid tight manner, such that the connection will withstand the relatively high pressures of a public water main system over an indefinite period of time, without significant leakage. The piston assembly may be, for example, a continuously formed piston assembly having a hollow outer sleeve and a piston disposed within the sleeve. The piston of the continuously formed piston assembly may be configured to move within the sleeve of the assembly in a substantially fluid tight manner while exposed to a hydrostatic pressure of at least 100 psi, which is typical of many public utility water mains. Thus, a piston assembly according to the present teachings will typically be configured to withstand a water pressure of at least 100 psi, for an indefinite period of time, without leaking significantly. Additionally, a top surface or head portion of the piston may be configured to withstand repeated blows from a mallet.

At step 414, the supply or water main side valve of the water service line is opened to establish a water main pressure against a bottom surface of the piston of the piston assembly. The water main pressure established against the piston will typically be at least 20 psi, and in many cases may be at least 40 psi, 65 psi, 100 psi, 150 psi, or any other pressure at which a public water main may operate. Piston assemblies according to the present teachings should be configured to withstand the water main pressure anticipated in a particular situation. Because of the variation of water main pressures, piston assemblies according to the present teachings will often be configured to withstand at least some maximum pressure expected in any water main system, such as 150 psi, 200 psi, or more.

At step 416, a head portion or top surface of a piston assembly is struck, causing the piston to be moved abruptly such that the bottom surface of the piston creates a hydraulic pulse to travel through the water service line. More specifically, striking the head portion of the piston assembly causes a hydraulic pulse to travel from the bottom surface of the piston into the supply side or water main side of a water service line. A hydraulic pulse, such as a pulse created by striking the piston assembly, has been found effective to dislodge mineral buildup within the water service line itself, and/or a junction between the water service line and the water main, commonly known as the "corporation stop" of the service line.

Because striking the piston assembly to create hydraulic pulses causes an increase in the water pressure exerted against the piston, piston assemblies according to the present teachings will typically be configured to withstand pressures exceeding the expected water main pressure by a significant amount. For example, when water main pressures on the order of 100 psi are expected, the piston assembly may be configured to withstand 200 psi or even 300 psi of pressure, to accommodate the pressure increases resulting from mallet strikes.

At step 418, a flow rate of 20 gallons per minute or higher is measured in the water service line. The increase in flow rate to at least 20 gallons per minute may be attributable to the clearance or removal of mineral buildup between the service line running between the water main and the water meter, at the corporation stop formed by the junction of the water main and the service line, or both.

Mineral buildup removed by the presently disclosed methods and apparatus may include, for example, manganese, iron, and/or calcium. However, any other mineral found in a water main or water service line also may constitute mineral buildup as referred to herein, and that the presently disclosed methods and apparatus are configured to remove. As described above, such mineral buildup may be present not only within a service line, but also at the corporation stop or junction between the water service line and the water main. For example, at the corporation stop, mineral buildup causing an unacceptably low flow rate may have a thickness between ⅛ and ¾ inches, and in the water service line, mineral buildup may have a thickness between 1/16 and ⅛ inches.

While the concepts discussed above have been described primarily in the context of removing build-up from a utility service line, it should be apparent that the present teachings may be applied to dislodging unwanted build-up in any sort of pipe or system of pipes. For example, the methods and apparatus described above may be applied to flow problems in household plumbing systems, boiler systems, or plumbing systems aboard ships, among others. Furthermore, the methods and apparatus described above are intended to be merely exemplary. Other methods of producing hydraulic pulses or shock waves in pipes, aside from those relying upon striking a piston, are within the scope of the present teachings.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

What is claimed is:

1. A method of dislodging mineral build-up in a water service line connected to a public utility water main, comprising:

measuring a flow rate of less than 20 gallons per minute in a water service line connecting a public utility water main to a plumbing system associated with a real property;

closing a supply side valve of the water service line;

closing a customer side valve of the water service line;

removing a water meter from the water service line to reveal a supply side connection point and a customer side connection point;

connecting an extension pipe to the supply side connection point of the water service line;

connecting a piston assembly to the extension pipe in a substantially vertical orientation;

opening the supply side valve of the water service line to establish a water main pressure of at least 40 psi against a piston of the piston assembly;

striking a head portion of the piston assembly to cause a hydraulic pulse to travel from the piston into the supply side of the water service line and thus to dislodge mineral buildup within at least one of the water service line and a junction between the water service line and the water main; and measuring a flow rate of 20 gallons per minute or higher in the water service line.

2. The method of claim 1, wherein the water main pressure established against the piston is at least 65 psi.

3. The method of claim 1, wherein the water main pressure established against the piston is at least 100 psi.

4. The method of claim 1, wherein the mineral buildup consists essentially of minerals selected from the group consisting of manganese, iron, and calcium.

5. The method of claim 4, wherein prior to striking the head portion of the piston assembly, the mineral buildup is present within the junction between the water service line and the water main with a thickness of at least ⅛ inches.

6. The method of claim 4, wherein prior to striking the head portion of the piston assembly, the mineral buildup is present within the water service line with a thickness of at least 1/16 inches.

7. A method of dislodging mineral build-up in a water service line connected to a public utility water main, comprising:

measuring a flow rate of less than 20 gallons per minute in a water service line connecting a public utility water main to a plumbing system associated with a real property;

closing a water main side valve of the water service line;

closing a property side valve of the water service line;

removing a water meter from the water service line to reveal a water main side connection point and a property side connection point;

connecting a continuously formed piston assembly to the water main side connection point, the piston assembly having a hollow outer sleeve, a piston disposed within the sleeve and configured to move within the sleeve in a substantially fluid tight manner while exposed to pressures of at least 100 psi, and a top surface of the piston configured to withstand repeated blows from a mallet;

opening the supply side valve of the water service line to establish a water main pressure of at least 20 psi against a bottom surface of the piston;

striking the top surface of the piston to cause the piston to be moved abruptly so that the bottom surface of the piston creates a hydraulic pulse that travels into the water main side of the water service line and dislodges mineral buildup within at least one of the water service line and a junction between the water service line and the water main; and measuring a flow rate of 20 gallons per minute or higher in the water service line.

8. The method of claim 7, wherein the water main pressure established against the piston is at least 65 psi.

9. The method of claim 7, wherein the mineral buildup consists essentially of minerals selected from the group consisting of manganese, iron, and calcium.

10. The method of claim 7, wherein prior to striking the head portion of the piston assembly, the mineral buildup is present within the junction between the water service line and the water main and has a thickness between ⅛ and ¾ inches.

11. The method of claim 7, wherein prior to striking the head portion of the piston assembly, the mineral buildup is present within the water service line and has a thickness between 1/16 and ⅛ inches.

12. A method of dislodging mineral build-up in a water service line connected to a public utility water main, comprising:

measuring a flow rate of less than 20 gallons per minute in a water service line that supplies water from a public utility water main to a real property;

closing a supply side valve of the water service line;

closing a customer side valve of the water service line;

removing a water meter from the water service line;

connecting a piston assembly to a supply side of the water service line;

opening the supply side valve of the water service line to establish a water main pressure of at least 20 psi against a piston of the piston assembly;

striking a head portion of the piston assembly to cause a hydraulic pulse to travel from the piston into the supply side of the water service line and to dislodge mineral buildup within at least one of the water service line and a junction between the water service line and the water main; and measuring a flow rate of 20 gallons per minute or higher in the water service line.

13. The method of claim 12, wherein the water main pressure established against the piston is at least 40 psi.

14. The method of claim 12, wherein the water main pressure established against the piston is at least 65 psi.

15. The method of claim 12, wherein the mineral buildup consists essentially of minerals selected from the group consisting of manganese, iron, and calcium.

16. The method of claim 12, wherein prior to striking the head portion of the piston assembly, the mineral buildup is present within the junction between the water service line and the water main and has a thickness greater than ⅛ inches.

17. The method of claim 12, wherein prior to striking the head portion of the piston assembly, the mineral buildup is present within the water service line and has a thickness greater than 1/16 inches.

18. The method of claim 12, wherein the piston assembly is configured to withstand a pressure of at least 200 psi.

* * * * *